US006520083B2

(12) United States Patent
Petersen et al.

(10) Patent No.: US 6,520,083 B2
(45) Date of Patent: Feb. 18, 2003

(54) APPARATUS FOR PRODUCING PRINTING PLATES HAVING MOVABLE JOURNAL FOR AXIAL REMOVAL OF PLATE

(75) Inventors: Godber Petersen, Augsburg (DE); Josef Göttling, Friedberg (DE); Thomas Hartmann, Friedberg (DE)

(73) Assignee: MAN Roland Druckmaschinen AG, Offenbach am Main (DE)

( * ) Notice: Subject to any disclaimer, the term of this patent is extended or adjusted under 35 U.S.C. 154(b) by 0 days.

(21) Appl. No.: 09/746,136

(22) Filed: Dec. 21, 2000

(65) Prior Publication Data

US 2001/0004864 A1 Jun. 28, 2001

(30) Foreign Application Priority Data

Dec. 22, 1999 (DE) ..... 199 61 867

(51) Int. Cl.[7] ..... B41N 3/00; B41F 13/20

(52) U.S. Cl. ..... 101/401.1; 101/216; 101/DIG. 36

(58) Field of Search ..... 101/216, 217, 101/375, 376, 479, 480, DIG. 35, DIG. 40, 401.1, 246, 463.1

(56) References Cited

U.S. PATENT DOCUMENTS

| | | | | |
|---|---|---|---|---|
| 4,414,898 A | | 11/1983 | Westerkamp et al. | 101/248 |
| 5,079,401 A | | 1/1992 | Suchan | 219/121.68 |
| 5,198,636 A | | 3/1993 | Suchan | 219/121.68 |
| 5,784,961 A | * | 7/1998 | Lorig et al. | 101/216 |
| 6,003,442 A | * | 12/1999 | Solomon et al. | 101/409 |
| 6,070,528 A | | 6/2000 | Fleischmann et al. | 101/170 |
| 6,186,065 B1 | * | 2/2001 | Kersch et al. | 101/212 |
| 6,186,068 B1 | * | 2/2001 | Gelbart | 101/401.1 |
| 6,213,020 B1 | * | 4/2001 | Kawada et al. | 101/401.1 |
| 2001/0006025 A1 | | 7/2001 | Göttling et al. | 101/170 |
| 2001/0006026 A1 | | 7/2001 | Göttling et al. | 101/216 |

FOREIGN PATENT DOCUMENTS

| | | |
|---|---|---|
| DE | 43 42 954 | 6/1995 |
| DE | 196 24 441 | 4/1997 |
| DE | 199 61 868 | 5/2001 |
| DE | 199 61 866 | 6/2001 |
| JP | 7-1175 | 1/1995 |

* cited by examiner

*Primary Examiner*—Leslie J. Evanisko
(74) *Attorney, Agent, or Firm*—Cohen, Pontani, Lieberman & Pavane

(57) ABSTRACT

An apparatus for producing printing plates on a supporting cylinder is provided. Mountings arranged on a frame accommodate a blank printing plate arranged on a supporting cylinder. The supporting cylinder is driven by a motor. The apparatus allows the supporting cylinder to be exposed at an end opposite the motor by its journal together with the mounting accommodating the journal. Thus, the supporting cylinder is capable of being moved away from the frame at one end, which makes it possible to draw the printing plate axially off the supporting cylinder. The apparatus can be used to produce a variety of printing plates, including: a relief printing plate, an offset printing plate, a sleeve-like printing plate, and a gravure printing plate.

20 Claims, 6 Drawing Sheets

APPARATUS FOR PRODUCING PRINTING PLATES HAVING MOVABLE JOURNAL FOR AXIAL REMOVAL OF PLATE

BACKGROUND OF THE INVENTION

1. Field of the Invention

The present invention relates to an apparatus for producing printing plates.

2. Description of the Related Art

An apparatus is known in which a cylinder for receiving an image is clamped into tail stocks of a guide bed. A gravure printing plate is engraved in this cylinder by means of an image setting device in the form of an electronically controlled gauge. In order to remove the cylinder, at least one tail stock has to be moved sideways. This takes up a great deal of space, in particular when removing a sleeve-like printing plate. In addition, making the change is time consuming and cumbersome.

SUMMARY OF THE INVENTION

The object of the present invention is to provide an economical apparatus for making a printing plate where the printing plate can be changed in a small space. The present invention is particularly useful for changing sleeve-like printing plates.

According to the present invention, the apparatus includes a frame, two mounting elements, a supporting cylinder, two journals, a printing plate and a motor. The mounting elements are arranged on the frame. The supporting cylinder is interposed between the mounting elements. One journal, the first journal, is removeably attached to an end of the supporting cylinder and is arranged on a first mounting element. The second journal is between a second end of the supporting cylinder and the second mounting element. The printing plate is arranged on the supporting cylinder. The motor is arranged on the frame for driving the second mounting element and the supporting cylinder. The first journal together with the first mounting element are moveable away from the supporting cylinder so as to expose the supporting cylinder at the first end and allow the printing plate to be axially removed from the supporting cylinder. The device thus allows for the supporting cylinder to be exposed at one end, after which a printing, plate can be slid axially onto or off the supporting cylinder in a short time. As a result, the change is readily possible, due to the cantilevered mounting of the supporting cylinder exposed at one end. The conditions necessary for quick setting of an image on the printing plate are created in an economical and space saving manner.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

In the drawings, where like reference characters denote similar elements throughout the several views, the present invention is shown in schematic form as follows.

DETAILED DESCRIPTION OF THE PRESENTLY PREFERRED EMBODIMENTS

Figure 1:
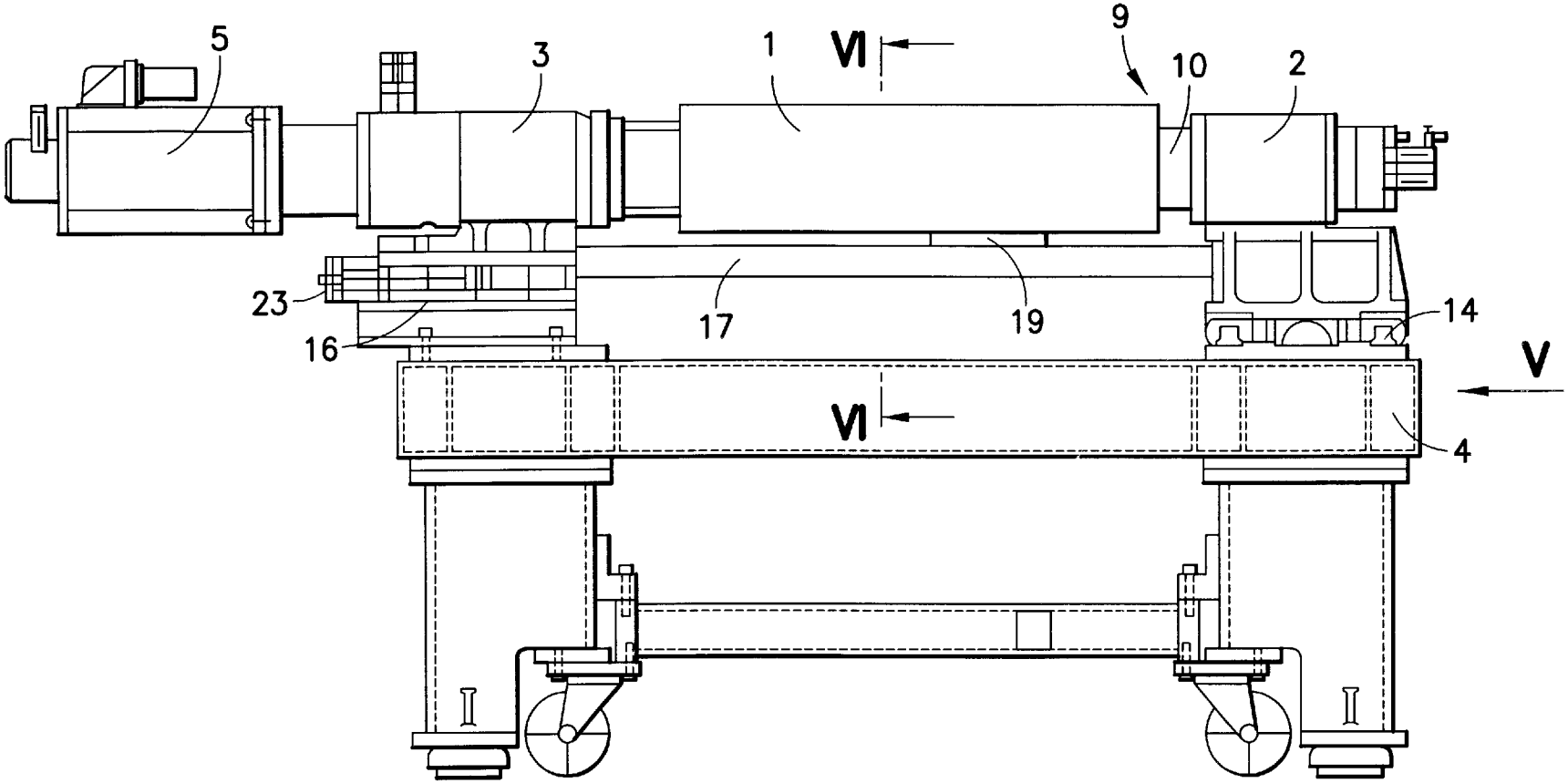
FIG. 1 is an elevation view of an apparatus for producing printing plates.
Figure 4:
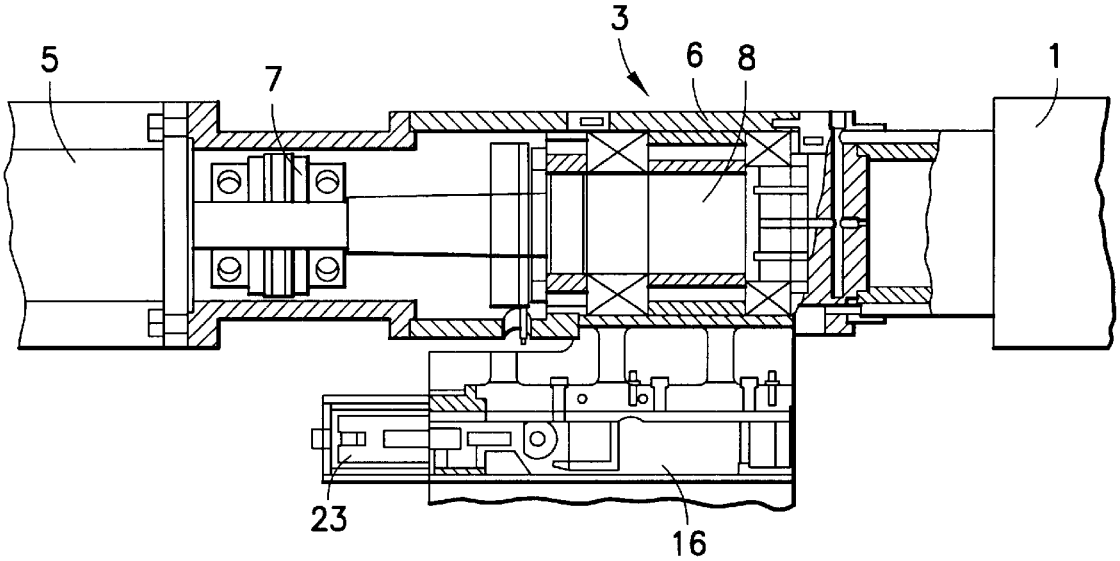
FIG. 4 is a partial sectional view of IV from FIG. 2.
Figure 4A:
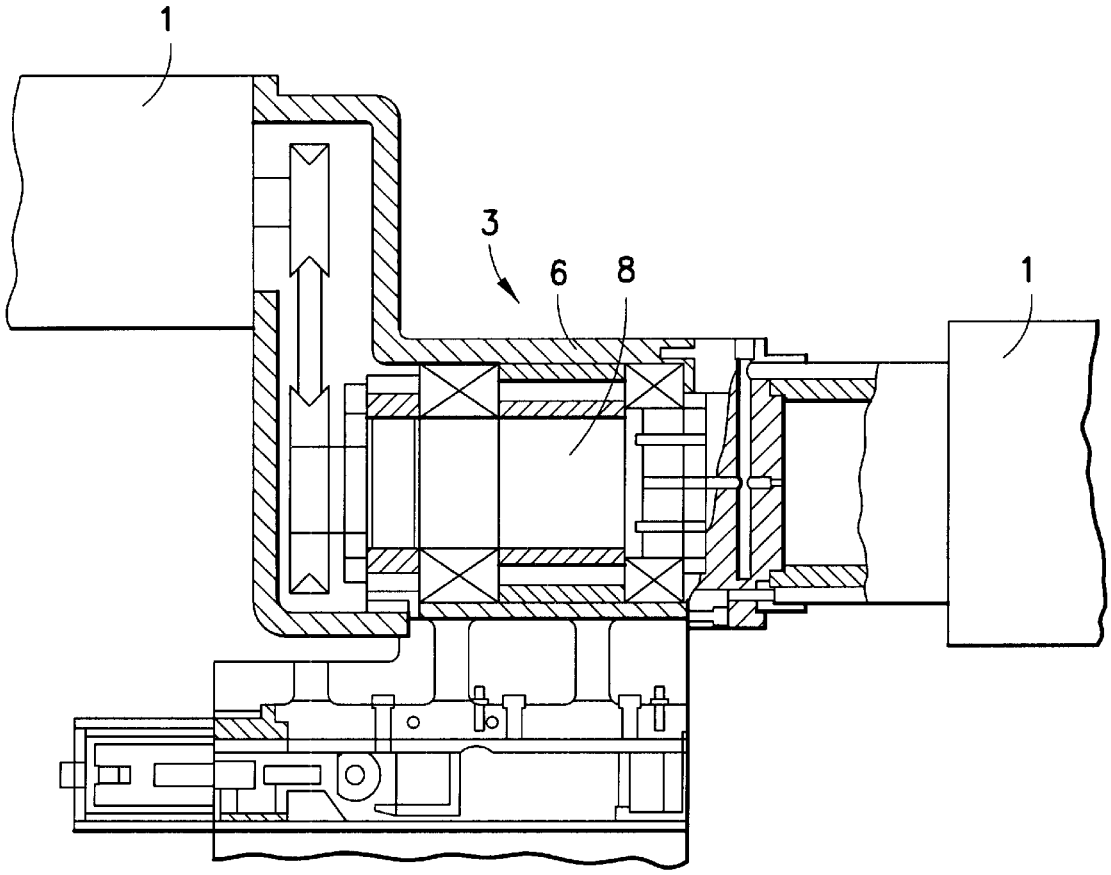
FIG. 4A is a view as in FIG. 4 of another embodiment.
Figure 4B:
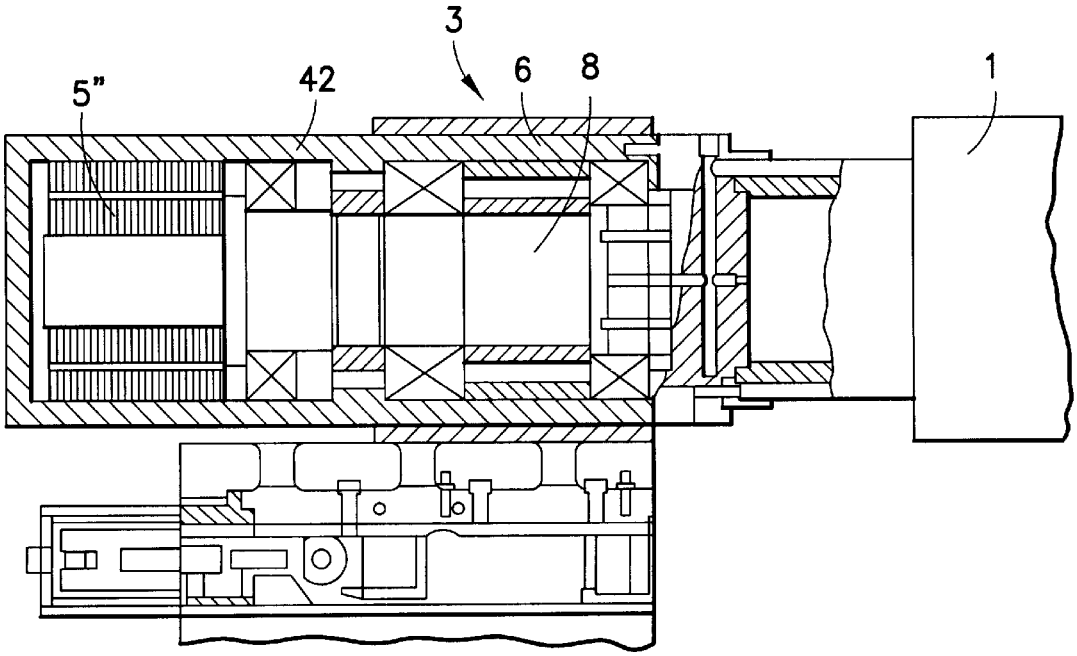
FIG. 4B is a view as in FIG. 4 of another embodiments.

Referring to FIG. 1, an apparatus according to the present invention is shown. The apparatus comprises a supporting cylinder 1, which is mounted at both ends in a first and second mounting 2, 3. Both mountings 2, 3 are arranged on a frame 4. The second mounting in this embodiment is designed as a fixed bearing and the first mounting 2 is designed as a loose bearing. As a result of this mounting configuration, the bearings are protected and there is no transmission of stresses to the frame. The supporting cylinder 1 is driven by a motor 5 which, for this purpose, is flange mounted to the housing 6 of the second mounting 3 (shown in FIG. 4). The motor 5 is arranged coaxially with the longitudinal axis (axis of rotation) of the supporting cylinder 1. The output shaft of the motor 5 can advantageously be connected, by means of a coupling 7, to a second journal 8 of the supporting cylinder 1. Alternatively, the supporting cylinder can also be driven by a flexible drive via a motor flange mounted to the second mounting 3 so as to be offset axially in relation to the supporting cylinder (see FIG. 4A). In this case, the output shaft of the motor 5' and the second journal 8 of the supporting cylinder 1 each bear a belt pulley. It is also possible, for example, for the second mounting 3 to be designed as a supporting tube 42, in which a spindle connected to the supporting cylinder 1 is mounted. In this case, the motor 5" is additionally arranged in the supporting tube and connected to the spindle as shown in FIG. 4B. A cylinder driven in this way is shown, for example, in German Patent reference DE 19624394 C1. It is also possible to use an axial motor placed in the interior of the supporting cylinder 1.

Figure 3:
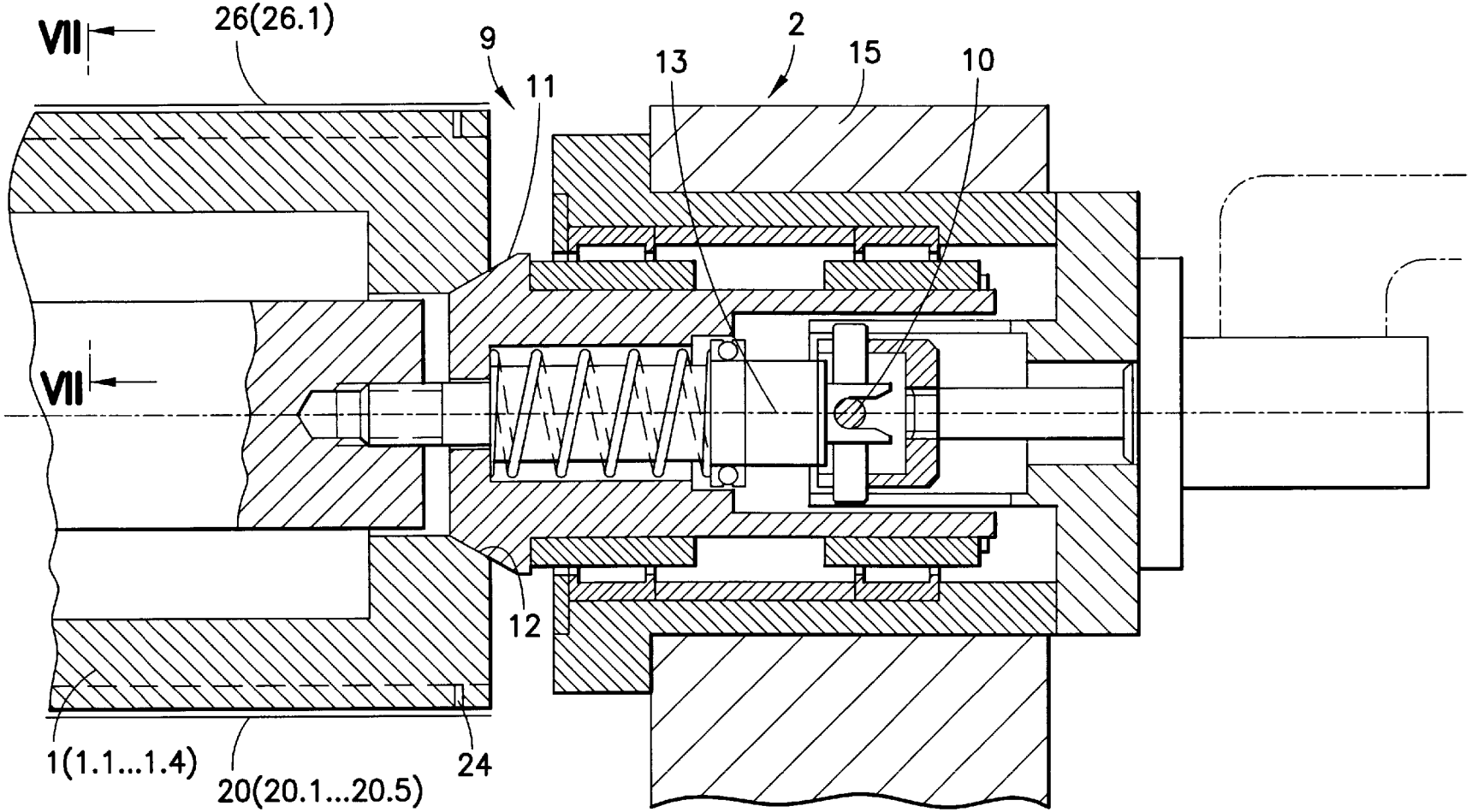
FIG. 3 is a sectional view of III—III from FIG. 2.

Advantageously, the supporting cylinder 1 can be exposed at the first end 9 opposite the motor 5. A first journal 10 can be separated from the supporting cylinder 1 and, together with the first mounting 2, be moved away from the supporting cylinder 1. In this embodiment, the separating point is designed as a pair of tapers with an external and internal taper 11, 12, which are associated with the supporting cylinder 1 and the first journal 10 respectively (FIG. 3). The separating point can also contain a fit with external and internal diameter areas, or can be designed with a Hirth toothing system. The first journal 10 is screwed to the supporting cylinder 1 by means of a screw element 13. After the screw element 13 has been loosened, the first journal 10 together with the first mounting 2 and the supporting cylinder 1 can be moved away from each other. The actions of loosening the screw element 13, and tightening it, can be done by machine. The device relating to this is described in German Patent Application DE 19961868.2.

The first mounting 2 can be moved transversely with respect to the longitudinal axis of the supporting cylinder 1. For this purpose, it is mounted on the frame 4 by means of first linear guides 14 (FIG. 1). The guide rails of the first liner guides 14 are screwed to the frame 4, and the associated guide carriages are screwed to the housing 15 of the first mounting 2. A working cylinder 22 is attached to the mounting 2 for executing the displacement movement. As can best be seen in FIG. 5, the working cylinder is also supported on the frame 4. Other drives are also possible.

Figure 6:
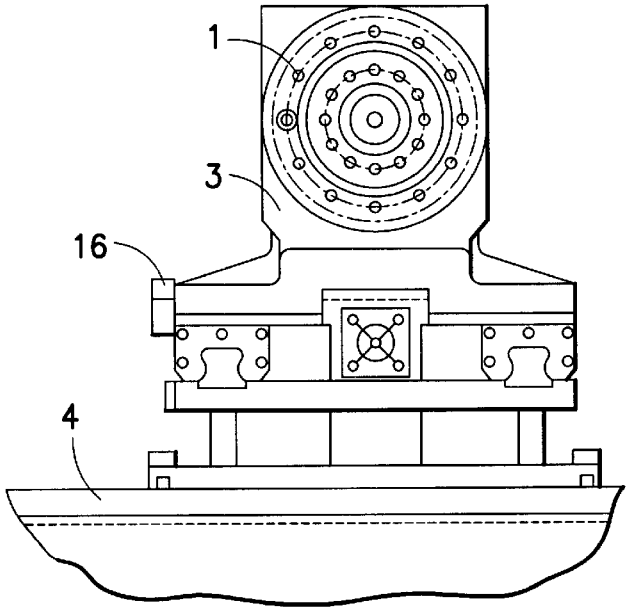
FIG. 6 is a sectional view of VI—VI from FIG. 1.

The second mounting 3 is mounted on the frame 4 by means of second linear guides 16 such that it can be displaced in the longitudinal direction of the supporting cylinder 1 (FIG. 6). A working cylinder 23 which is supported on the frame 4 is attached to the housing 6 of the second mounting 3 to provide the displacement movement (FIG. 4). Other drives are also possible.

Figure 2:
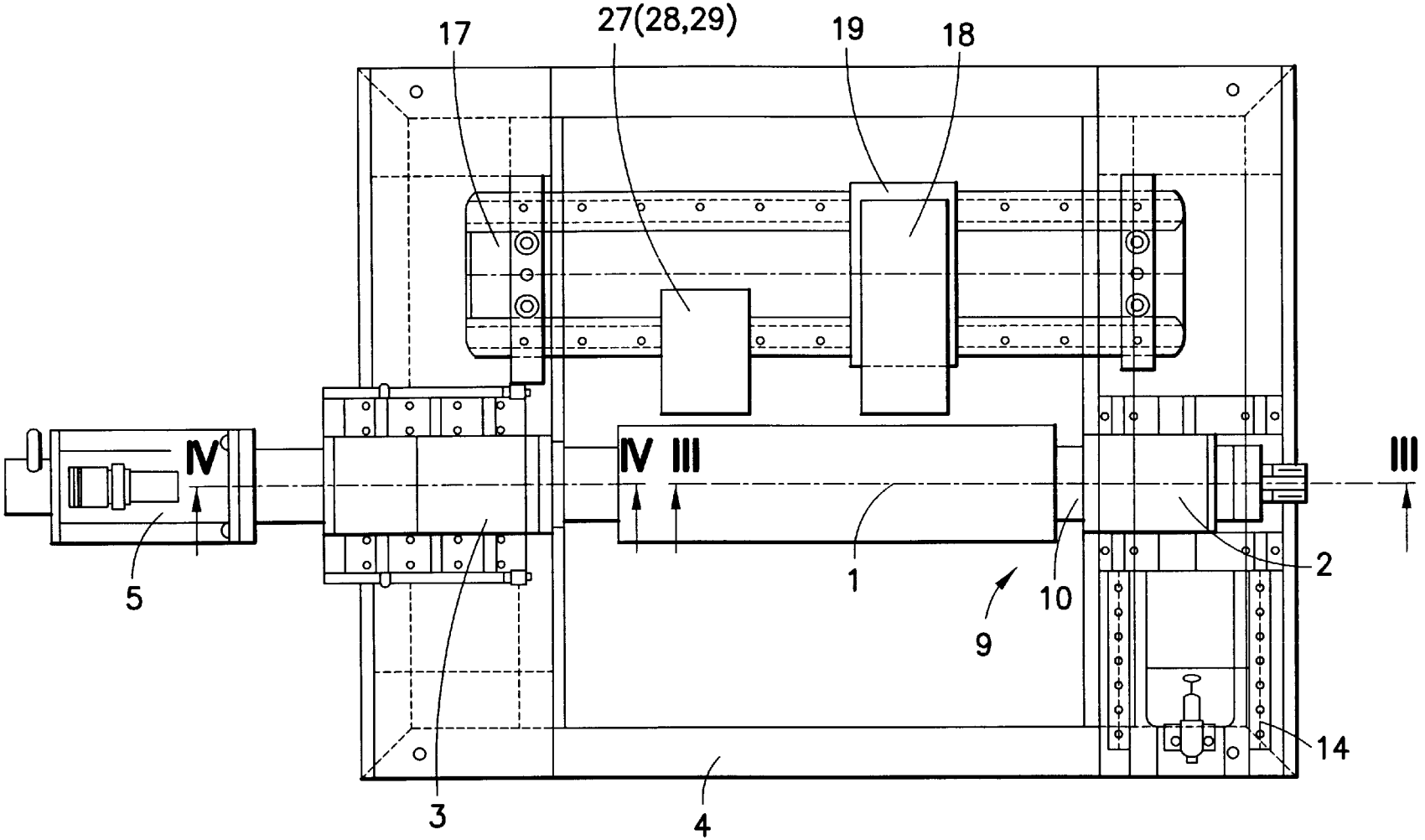
FIG. 2 is a plan view of the apparatus showing FIG. 1.
Figure 5A:
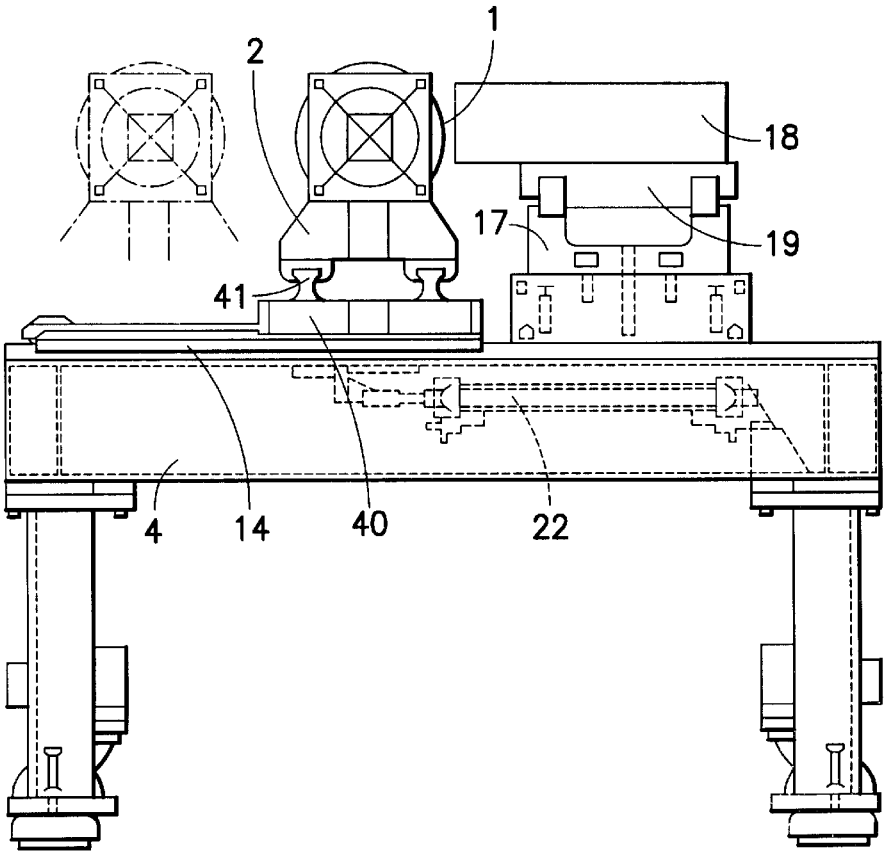
FIG. 5A is a view as in FIG. 5 of another embodiment.
Figure 5:
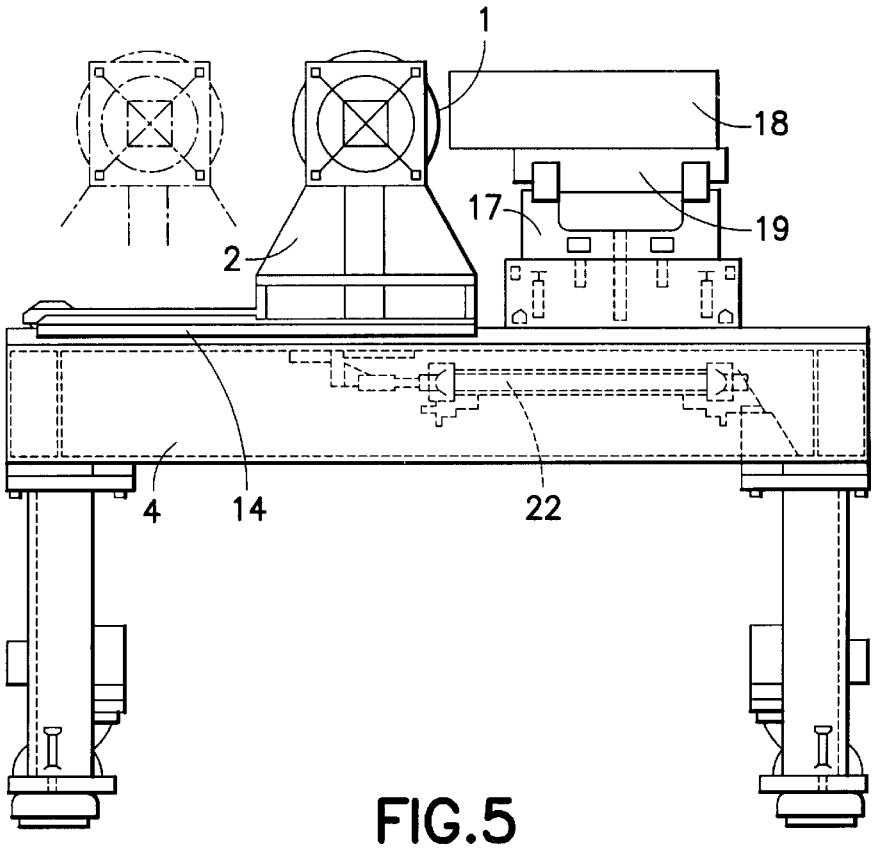
FIG. 5 is a side view of V from FIG. 1.

The frame 4 also accommodates a crossmember 17, on which an image setting device 18 can be moved along the supporting cylinder 1 (FIG. 2). For this purpose, the image setting device 18 is fixed to a carriage 19 which can be moved on the crossmember 17 (FIG. 5).

A sleeve-like printing plate 20 can be fitted to the supporting cylinder 1. For this purpose, the supporting cylinder 1 is first exposed at its first end 9. To do this, the screw element 13 is loosened, after which the first journal 10 can be separated from the supporting cylinder 1. This is performed by appropriately driving the working cylinder 23, retracting its piston rod, while at the same time moving the second mounting 3, together with the supporting cylinder 1, to the left (FIG. 4). The supporting cylinder 1 is moved away from the first journal 10 to such an extent that the internal taper 12 of the supporting cylinder no longer covers the external taper 11 of the first journal 10. The first mounting 2 together with the first journal 10 is then moved into the position shown by dashed lines in FIG. 5 by driving the working cylinder 22 appropriately on the linear guides 14. From the now freely accessible first end 9 of the supporting cylinder 1, which is held in cantilever fashion by the second mounting 3, the sleeve-like printing plate 20 can be pushed onto the supporting cylinder 1. To support or permit this installation, air is blown from holes 24 against the inner wall of the printing plate 20, by which means the printing plate 20 is widened elastically. Possible ways of feeding in compressed air are indicated in German Patent Application DE 19961866.6. Then, by reversing the working cylinder 22, the first mounting 2 is moved into its initial position again, in which the journal 10 points with its external taper 11 to the supporting cylinder 1. The working cylinder 23 is then reversed. As a result, the supporting cylinder 1 is moved towards the first journal 10, until the internal taper 12 of the supporting cylinder 1 comes to rest on the external taper 11 of the first journal 10. The screw element 13 is then screwed into the supporting cylinder 1, and a firm connection is produced between the first journal 10 and the supporting cylinder 1. An image can be set on the sleeve-like printing plate 20 by activating and moving the image setting device 18 on the crossmember 17 while driving the supporting cylinder 1 with the motor 5. This is carried out very accurately since the supporting cylinder 1 is mounted at both ends. The pair of tapers between the supporting cylinder 1 and the journal 10 also help to stabilize the support cylinder 1 so as to avoid system distortions.

In an embodiment of the present invention, the sleeve-like printing plate 20 is an offset printing plate which, for example, has an image set on it in accordance with the method described in German reference no. DE 198 11 029 A1. However, a flexographic printing plate 20.1, on which an image is set, for example, in accordance with a method according to German reference no. DE 43 42 954 C2, or a gravure printing plate 20.2, on which an image is set, for example, in accordance with a method according to German reference no. DE 196 24 441 C1, can also be arranged on the supporting cylinder 1.

Figure 7:
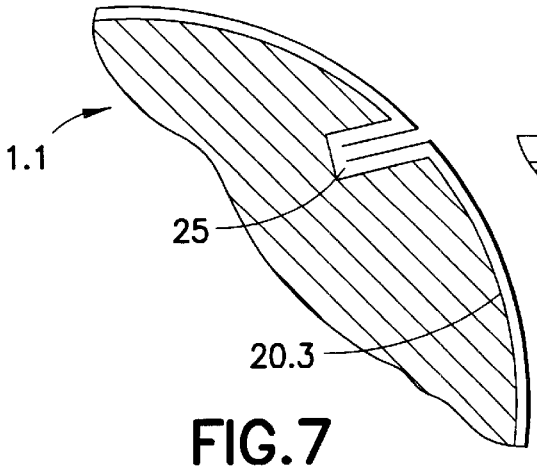
FIG. 7 is a sectional view of VII—VII from FIG. 3.

Referring now to FIG. 7, a further modification of an embodiment of the present invention is shown. In this case, finite printing plates 20.3 can be arranged on a supporting cylinder 1.1 having an appropriate clamping device 25. Shown by way of example is a slit-like clamping device 25 of this type. If appropriate, a sleeve-like printing plate 20 can also be clamped onto a supporting cylinder 1.1 equipped with the clamping device 25. Following the above described steps to expose the first end of the supporting cylinder 1.1, the finite printing plate 20.3 can be changed by being pushed on or drawn off axially. If appropriate, if the supporting cylinder 1.1 is equipped with a suitable clamping device 25, a finite printing plate 20.3 can also be changed without exposing the first end of the supporting cylinder 1.1.

In a still further embodiment, the supporting cylinder 1 can be interchanged with a supporting cylinder 1.2 of a different diameter. In this way, printing plates 20.4 of different formats can have images set on them by the image setting device.

Printing plates 20.4 of different format can also be clamped on a supporting cylinder 1.3 if the supporting cylinder 1.3 bears an intermediate sleeve 26 (shown by thin lines in FIG. 3), on which the printing plate 20.4 is clamped. After the intermediate sleeve 26 has been drawn off axially and an intermediate sleeve 26.1 with a different external diameter has been pushed on, an appropriate printing plate 20.4 with a different format can be clamped onto the supporting cylinder 1.3. In order to accommodate the variability of format, sleeve-like printing plates 20.5 having different thicknesses can also be fitted to the supporting cylinder 1.3. The printing-plate sleeves 20, 20.1, 20.2, 20.4, 20.5 to be clamped on can be designed with or without a seam. The printing plate can also be engraved directly in the surface of a supporting cylinder 1.4, for example as a gravure printing plate. Following the setting of the image, the supporting cylinder 1.4 is then removed from the image setting device and inserted into the printing unit of a printing machine.

In the embodiment described, the action of moving the supporting cylinder 1 and the first mounting 2 away from each other was achieved by the supporting cylinder 1, together with the second mounting 3, being axially displaceable. Conversely, it is also possible to design the first mounting 2 to be displaceable in the axial direction of the supporting cylinder 1. In this case, advantageously the first mounting 2 is mounted on a cross-slide 40 having linear guides 41 as shown in FIG. 5A, with which both the displacement in the axial direction of the supporting cylinder 1 and also perpendicular thereto is possible. Alternatively, it is also possible to tilt the first mounting 2 away from the supporting cylinder 1.

Further devices for producing the printing plate can be set again the supporting cylinder 1, for example, an erasing device 27, a fixing device 28 and/or an application device 29 for the layers needed to be produce the printing plate.

Thus, while there have shown and described and pointed out fundamental novel features of the invention as applied to preferred embodiments thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

We claim:

1. An apparatus for making printing plates, comprising:

a frame;

a first mounting element and a second mounting element arranged on an upper surface of the frame;

a supporting cylinder interposed between the first mounting element and the second mounting element, the supporting cylinder having a first end and a second end;

a first journal removeably attached to the first end of the supporting cylinder and arranged on the first mounting element;

a second journal interposed between the second end of the supporting cylinder and the second mounting element;

a blank printing plate arranged on the supporting cylinder and upon which an image can be set; and a motor arranged on the frame for driving the second journal and the supporting cylinder, wherein the first journal together with the first mounting element are moveable away from the supporting cylinder so as to expose the supporting cylinder at the first end and allow the printing plate to be axially removed from the supporting cylinder.

2. The apparatus according to claim 1, wherein the supporting cylinder is mounted in the second mounting element so as to prevent the supporting cylinder from being axially displaced.

3. The apparatus according to claim 1, wherein the motor is flange-mounted to the second mounting element coaxially with respect to a longitudinal axis of the supporting cylinder and is coupled to the second journal of the supporting cylinder.

4. The apparatus according to claim 1, further comprising:

a flexible drive connection between the motor and the second journal, the motor being flange-mounted to the second mounting so as to be offset axially with respect to a longitudinal axis of the supporting cylinder.

5. The apparatus according to claim 1, wherein the second mounting element comprises a supporting tube having a spindle connected to the supporting cylinder, the motor being arranged in the supporting tube and connected to the spindle.

6. The apparatus according to claim 1, wherein the printing plate is a sleeve printing plate clamped onto the supporting cylinder.

7. The apparatus according to claim 6, wherein the first mounting element and the second mounting element accommodate at least one further supporting cylinder having a diameter different from that of the supporting cylinder, rendering the supporting cylinder and the further supporting cylinder interchangeable with one another.

8. The apparatus according to claim 6, further comprising:

a first intermediate sleeve interchangably mounted on the supporting cylinder, upon which the sleeve printing plate can be clamped, the first intermediate sleeve having a first external diameter, wherein the first intermediate sleeve may be interchanged with a second intermediate sleeve having a second external diameter different from the first external diameter.

9. The apparatus according to claim 6, wherein a plurality of sleeve printing plates having different thicknesses can be interchangeably clamped onto the supporting cylinder.

10. The apparatus according to claim 1, wherein the printing plate is a finite printing plate, the apparatus further comprising:

a clamping device arranged on the supporting cylinder and capable of clamping to the finite printing plate.

11. The apparatus according to claim 1, wherein the printing plate is an offset printing plate arranged on the supporting cylinder.

12. The apparatus according to claim 1 wherein the printing plate is selected from the group consisting, of a relief printing plate and a flexographic printing plate.

13. The apparatus according to claim 1, wherein the printing plate is a gravure printing plate.

14. The apparatus according to claim 13, wherein the gravure printing plate is arranged in a surface of the supporting cylinder.

15. The apparatus according to claim 1, further comprising:

at least one additional device selected from the group consisting of an erasing device, a fixing device and an application device for layers needed to produce the printing plate, the additional device being set against the supporting cylinder.

16. An apparatus for making printing plates, comprising:

a frame;

a first mounting element and a second mounting element arranged on the frame;

a supporting cylinder interposed between the first mounting element and the second mounting element, the supporting cylinder having a first end and a second end;

a first journal removeably attached to the first end of the supporting cylinder and arranged on the first mounting element;

a second journal interposed between the second end of the supporting cylinder and the second mounting element;

a blank printing plate arranged on the supporting cylinder and upon which an image can be set;

a motor arranged on the frame for driving the second journal and the supporting cylinder, wherein the first journal together with the first mounting element are moveable away from the supporting cylinder so as to expose the supporting cylinder at the first end and allow the printing plate to be axially removed from the supporting cylinder; and second linear guide means for mounting the second mounting element on the frame so as to render the second mounting element displaceable in a longitudinal direction of the supporting cylinder.

17. The apparatus according to claim 16, further comprising:

a working cylinder attached to the second mounting element and supported on the frame.

18. The apparatus according to claim 16, further including:

first linear guide means for mounting the first mounting element onto the frame so as to render the first mounting element transversely displaceable with respect to a longitudinal axis of the supporting cylinder.

19. The apparatus according to claim 18, further comprising:

a working cylinder attached to the first mounting, element and supported on the frame.

20. An apparatus for making printing plates, comprising:

a frame;

a first mounting element and a second mounting element arranged on the frame;

a supporting cylinder interposed between the first mounting element and the second mounting element, the supporting cylinder having a first end and a second end;

a first journal removeably attached to the first end of the supporting cylinder and arranged on the first mounting element;

a second journal interposed between the second end of the supporting cylinder and the second mounting element;

a blank printing plate arranged on the supporting cylinder and upon which an image can be set;

a motor arranged on the frame for driving the second journal and the supporting cylinder, wherein the first journal together with the first mounting element are moveable away from the supporting cylinder so as to expose the supporting cylinder at the first end and allow the printing plate to be axially removed from the supporting cylinder; and a cross slide arranged on the frame, the first mounting element being mounted on the cross slide so as to be moved by the cross slide at least one of axially with respect to a longitudinal axis of the supporting cylinder and transversely with respect to the longitudinal axis of the supporting cylinder.

* * * * *